US007140921B2

(12) United States Patent
Liu

(10) Patent No.: US 7,140,921 B2
(45) Date of Patent: Nov. 28, 2006

(54) CONVERSION PLUG STRUCTURE HAVING A VARIABLE RESISTOR

(76) Inventor: Yau-Tzung Liu, 10F, No. 516, Ta An Rd., Shu Lin City, Taipei Hsien (TW)

( * ) Notice: Subject to any disclaimer, the term of this patent is extended or adjusted under 35 U.S.C. 154(b) by 113 days.

(21) Appl. No.: 10/885,127

(22) Filed: Jul. 7, 2004

(65) Prior Publication Data

US 2006/0009070 A1 Jan. 12, 2006

(51) Int. Cl.

| | |
|---|---|
| ***H01R 24/00*** | (2006.01) |
| ***H01R 25/00*** | (2006.01) |
| ***H01R 31/00*** | (2006.01) |
| ***H01R 27/02*** | (2006.01) |
| ***H01R 33/92*** | (2006.01) |

(52) U.S. Cl. ..... 439/638

(58) Field of Classification Search ..... 439/502, 439/955, 489, 490, 491, 505, 638, 639, 640, 439/488, 218

See application file for complete search history.

(56) References Cited

U.S. PATENT DOCUMENTS

| | | | | |
|---|---|---|---|---|
| 4,095,184 | A * | 6/1978 | Hochstein et al. | 455/73 |
| 5,497,094 | A * | 3/1996 | George | 324/529 |
| 6,049,143 | A * | 4/2000 | Simpson et al. | 307/126 |
| 6,548,986 | B1 * | 4/2003 | Jakubowski | 320/111 |

* cited by examiner

*Primary Examiner*—Chandrika Prasad
(74) *Attorney, Agent, or Firm*—Rosenberg, Klein & Lee

(57) ABSTRACT

A conversion plug structure having a variable resistor has a conversion adaptor and an intermediate adaptor. The conversion adaptor has a plurality of first terminals disposed therein. The intermediate adaptor has an insulating housing, a plurality of second terminals disposed in the insulating housing, and a variable resistor electrically connecting between one of the second terminals and a power cord. The rest of the second terminals electrically connects with the power cord.

3 Claims, 10 Drawing Sheets

CONVERSION PLUG STRUCTURE HAVING A VARIABLE RESISTOR

BACKGROUND OF THE INVENTION

1. Field of the Invention

The present invention relates to a conversion plug structure having a variable resistor, and more particularly, to a conversion plug structure connecting with an end of a power cord and providing various voltages via adjusting a variable resistor of an intermediate adaptor thereof.

2. Background of the Invention

Referring to FIG. 1, a conventional DC power cord 70 can connect with a conversion plug structure 80. The conversion plug structure 80 includes an intermediate adaptor 81 connecting with an end of the power cord 70 and a changeable conversion adaptor 82. The intermediate adaptor 81 has three insertion holes 83 at an end thereof and three first terminals 84 respectively disposed in the insertion holes 83 and electrically connecting with the power cord 70. The conversion adaptor 82 has second terminals 85 disposed at an end thereof. The second terminals 85 of the conversion adaptor 82 are capable of inserting in the corresponding insertion holes 83 of the intermediate adaptor 81, so that the second terminals 85 respectively electrically connect with the first terminals 84. Therefore, the conversion adaptor 82 connects with the intermediate adaptor 81 in an insertion and a changeable manner, the conversion adaptor 82 electrically connects with the intermediate adaptor 81 and the power cord 70, and electric power is transmitted to the conversion adaptor 82 via the power cord 70 and the intermediate adaptor 81.

Because the conversion adaptor 82 connects with the power cord 70 in a changeable manner, when the power cord 70 is used for different specifications of outlets of electric appliances, the conversion adaptor 82 can be changed to apply to various outlets without changing the power cord 70, thereby reducing fabrication costs and consumers' expenses.

The above power cord 70 can be applied to only one kind of voltage, but general electric appliances have various ranges of voltages including 15V, 16V, 17V, 19V, 20V, 22V, etc. Therefore, the power cord 70 does not have a widespread use.

FIG. 2 shows another conventional conversion plug structure 80. The conversion adaptor 82 is further divided into a first body 86 and a second body 87. The first body 86 and the second body 87 are connected with each other via a connection cord 88. A resistor (not shown) is disposed inside the conversion adaptor 82 in a proper position thereof. The voltage of the electric power transmitted by the power cord 70 can be changed via the resistor inside the conversion adaptor 82, and the conversion adaptor 82 can be changed to provide various voltages for various electric appliances without changing the power cord 70, thereby obtaining a widespread use. However, the conversion adaptor 82 has to be changed, so as to have different resistances, which increases costs and consumer' expenses.

Accordingly, as discussed above, the conventional conversion plug structure still has some drawbacks that could be improved. The present invention aims to resolve the drawbacks in the prior art.

SUMMARY OF INVENTION

The primary object of the invention is therefore to specify a conversion plug structure having a variable resistor, which is able to provide various voltages via adjusting a variable resistor of an intermediate adaptor thereof, so that a power cord does not have to be changed and has a widespread use, and a conversion adaptor and the intermediate adaptor do not have to be changed, so as to reduce costs and consumers' expenses.

According to the invention, the object is achieved via a conversion plug structure having a variable resistor. The conversion plug structure connects with an end of a power cord and comprises a conversion adaptor and an intermediate adaptor. The conversion adaptor has a plurality of first terminals disposed therein. The intermediate adaptor has an insulating housing, a plurality of second terminals disposed in the insulating housing, and a variable resistor electrically connecting between one of the second terminals and the power cord. The rest of the second terminals electrically connects with the power cord. The conversion adaptor connects with the intermediate adaptor in a changeable manner, and the second terminals electrically connect with the first terminals.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention which will be described hereinafter and which will form the subject of the claims appended hereto.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE EMBODIMENTS

Figure 1:
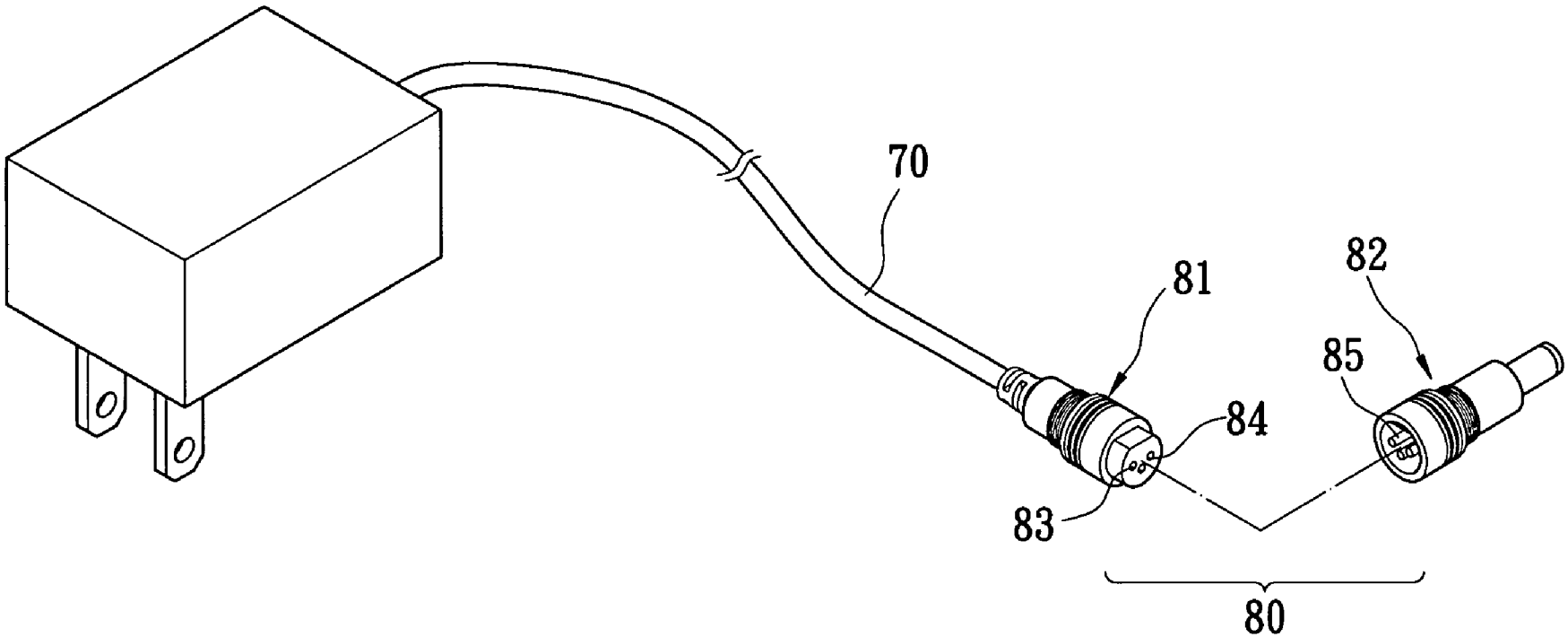
FIG. 1 PRIOR ART
FIG. 1 is an exploded perspective view of a conversion plug structure of the prior art.
Figure 2:
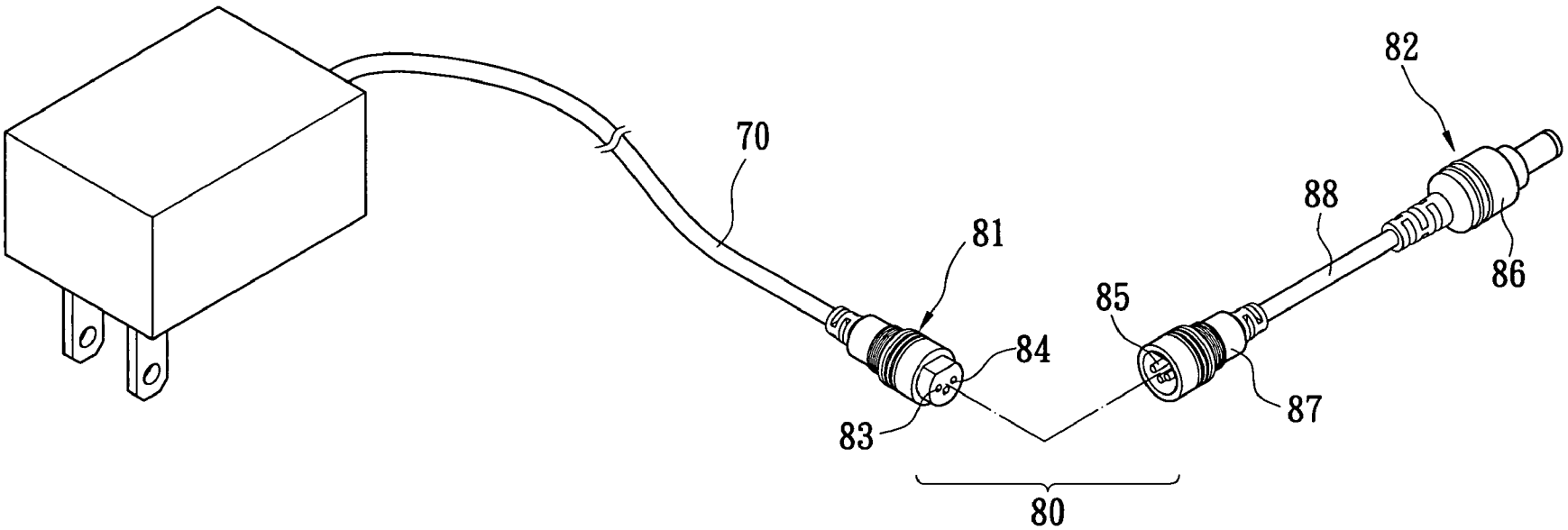
FIG. 2 PRIOR ART
FIG. 2 is an exploded perspective view of another conversion plug structure of the prior art.
Figure 3:
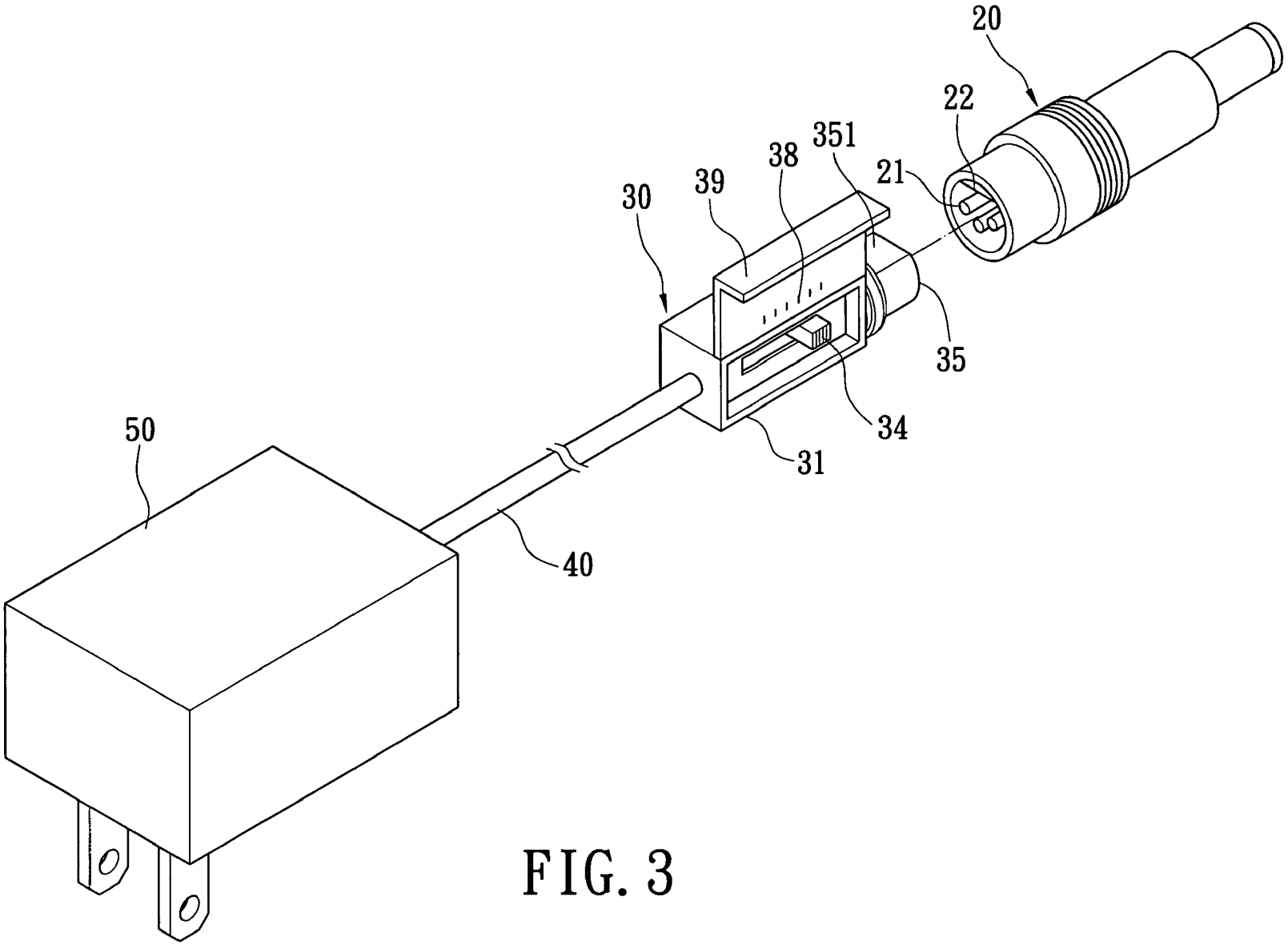
FIG. 3 is an exploded perspective view of a first embodiment of a conversion plug structure of the present invention.
Figure 4:
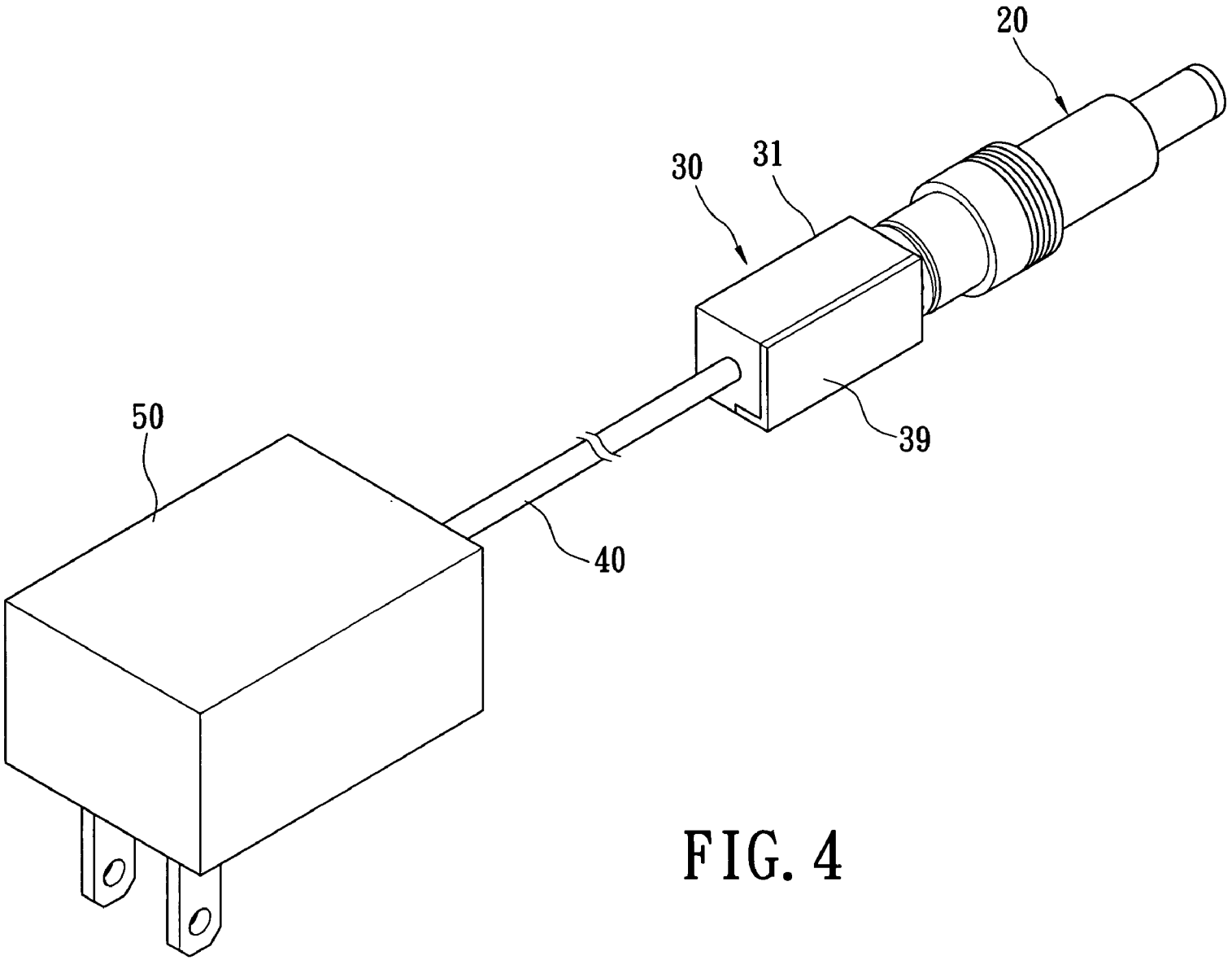
FIG. 4 is a perspective assembly view of the first embodiment of the conversion plug structure of the present invention.
Figure 5:
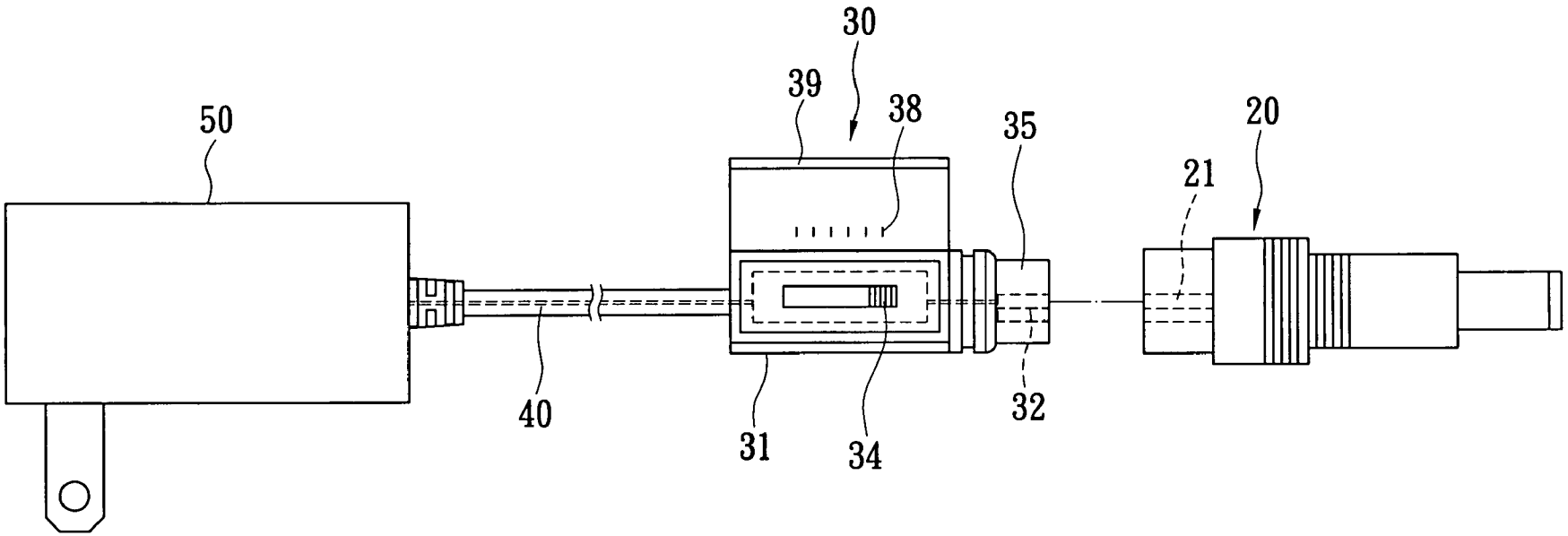
FIG. 5 is a planar schematic view of the first embodiment of the conversion plug structure of the present invention.

With respect to FIG. 3 to FIG. 5, the present invention provides a conversion plug structure having a variable resistor. The conversion plug structure connects with an end of a power cord 40. The power cord 40 connects with a proper transformer 50. The conversion plug structure comprises a changeable conversion adaptor 20 and an intermediate adaptor 30 connecting with the end of the power cord 40. The conversion adaptor 20 has a plurality of first terminals 21 disposed therein at an end thereof. The first terminals 21 are made of metal materials with good conductivity. The conversion adaptor 20 is substantially the same as that of the prior art, is not claimed in the present invention, and thus is not described in further detail.

Figure 6:
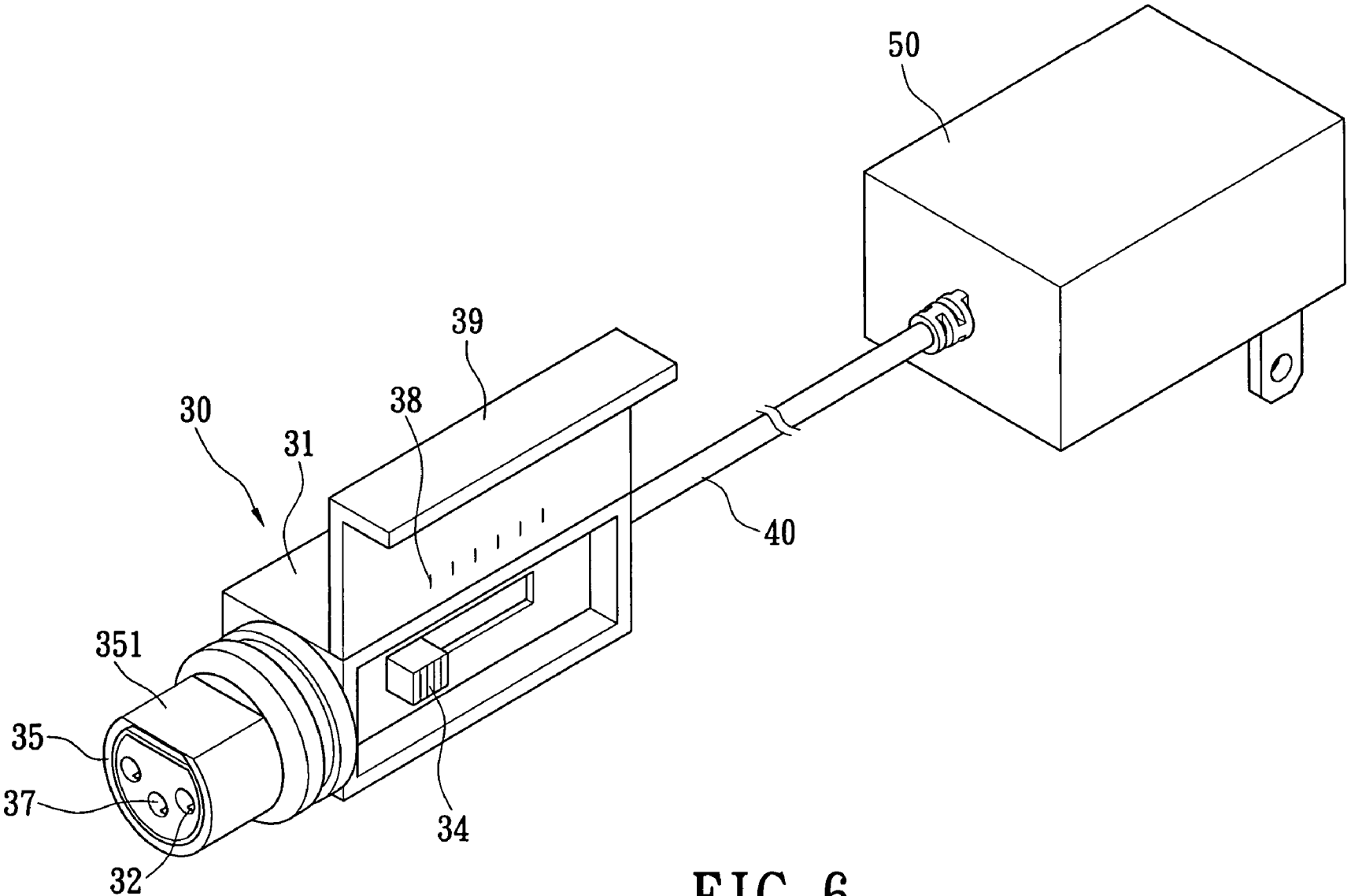
FIG. 6 is a perspective view of an intermediate adaptor of the first embodiment of the conversion plug structure of the present invention.

The intermediate adaptor 30 is disposed between the power cord 40 and the conversion adaptor 20. The intermediate adaptor 30 has an insulating housing 31, a plurality of second terminals 32, and at least one variable resistor 34 (see FIG. 6.) The insulating housing 31 is made of insulating materials such as plastic. The insulating housing 31 forms a first insertion portion 35 at an end thereof. The first insertion portion 35 corresponds to the end of the conversion adaptor 20 for inserting into the end of the conversion adaptor 20, so that the intermediate adaptor 30 connects with the conversion adaptor 20 in an insertion and a changeable manner.

The first insertion portion 35 of the intermediate adaptor 30 has a tangent plane 351 disposed at an outside thereof, and the conversion adaptor 20 has a corresponding tangent plane 22 disposed at the end thereof, so as to form an anti-disorientation device. Therefore, the connection between the intermediate adaptor 30 and the conversion adaptor 20 has to follow a certain direction when both are inserted into each other.

The second terminals 32 are made of metal materials with good conductivity, and are disposed in an end of the insulating housing 31. The first insertion portion 35 defines a plurality of first insertion holes 37 therein, and each of the second terminals 32 has an end respectively disposed in the first insertion holes 37. When the first insertion portion 35 of the intermediate adaptor 30 inserts into and connects with the end of the conversion adaptor 20, the second terminals 32 respectively and electrically connect with the first terminals 21 of the conversion adaptor 20, respectively inserting into the first insertion holes 37.

One of the second terminals 32 is as a grounding terminal, and the variable resistor 34 electrically connects between said one of the second terminals 32 and the power cord 40. The rest of the second terminals 32 electrically connects with the power cord 40 properly. The variable resistor 34 has multiple adjustable functions and can be adjusted to obtain a demand of resistance. The intermediate adaptor 30 has a covet 39 connecting with the insulating housing 31. When the variable resistor 34 has been adjusted already, the cover 39 is closed on the variable resistor 34 to avoid others changing the variable resistor 34. The cover 39 has a mark portion 38 marking various resistances with numbers or symbols.

Figure 7:
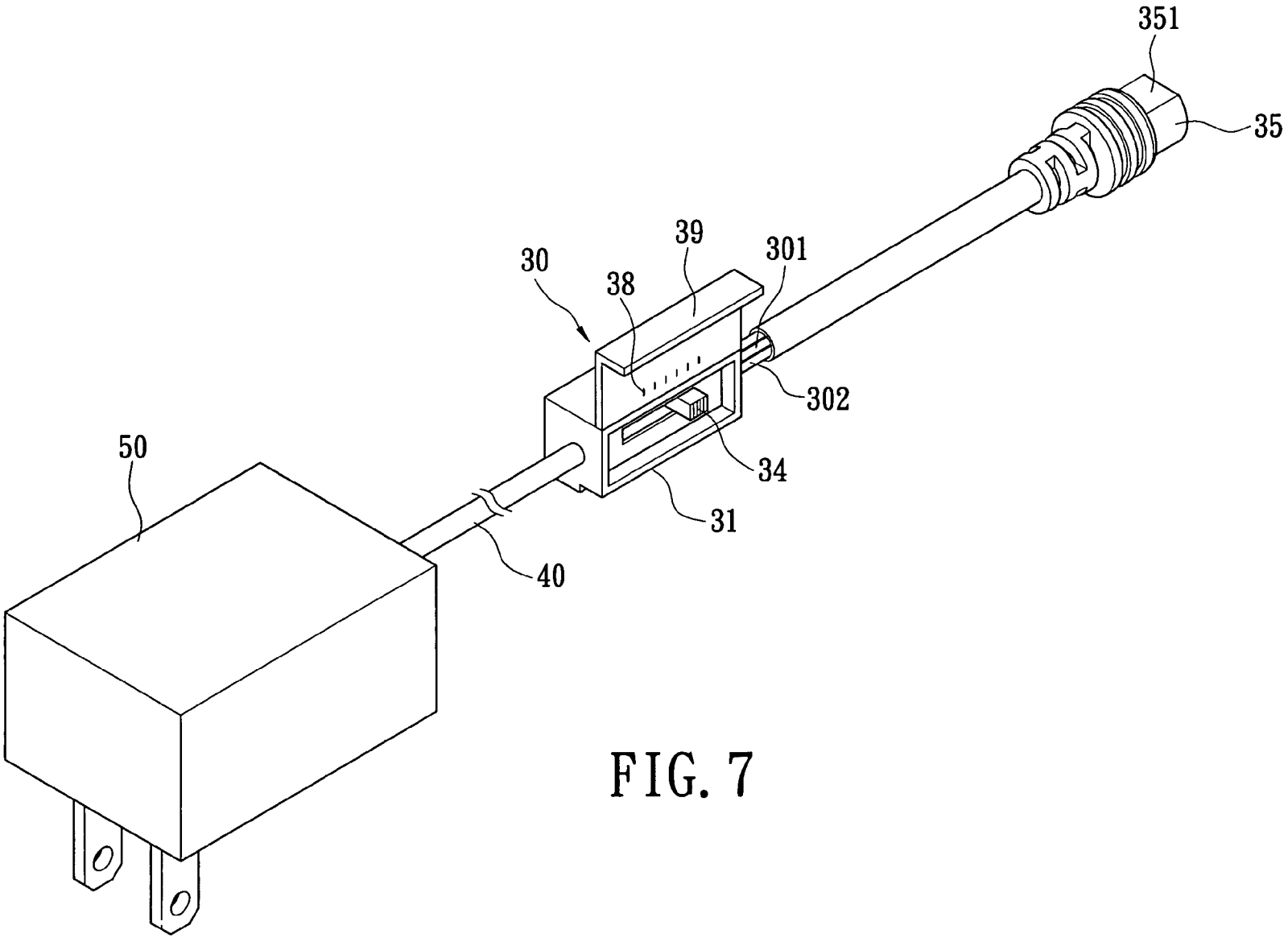
FIG. 7 is a perspective view of an intermediate adaptor of a second embodiment of a conversion plug structure of the present invention.
Figure 8:
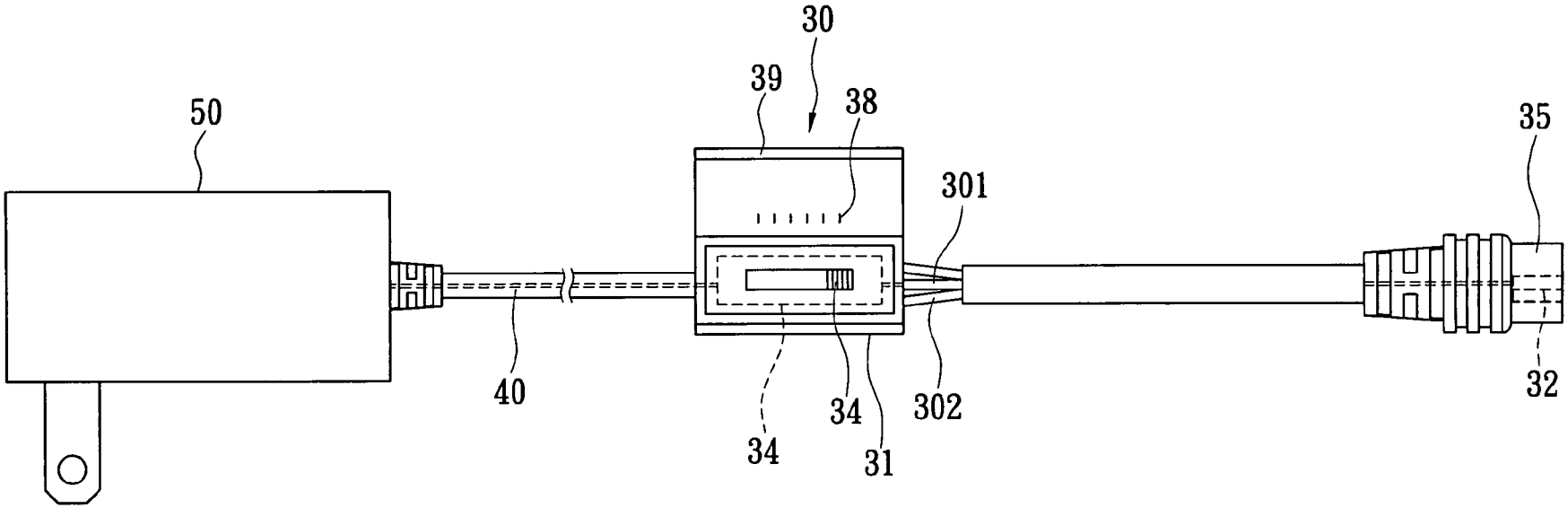
FIG. 8 is a planar schematic view of the intermediate adaptor of the second embodiment of the conversion plug structure of the present invention.

FIG. 7 and FIG. 8 show a second embodiment of the present invention. The insulating housing 31 of the intermediate adaptor 30 and the first insertion portion 35 are separate. The second terminals 32 are disposed in the first insertion portion 35. The variable resistor 34 connects with said one of the second terminals 32 via a first connection wire 301, and the rest of the second terminals 32 electrically connects with the power cord 40 via second connection wires 302 properly. The variable resistor 34 is a general resistor, a precise resistor, or a diode.

The intermediate adaptor 30 is disposed between the power cord 40 and the conversion adaptor 20 and has the variable resistor 34. The variable resistor 34 of the intermediate adaptor 30 is adjusted to obtain a demand of resistance to change a voltage transmitted by the power cord 40, thereby providing various voltages for electric appliances. Hence, the power cord 40 does not have to be changed and has a widespread use, and the conversion adaptor 20 and the intermediate adaptor 30 do not have to be changed, so as to reduce costs and consumers' expenses.

Figure 9:
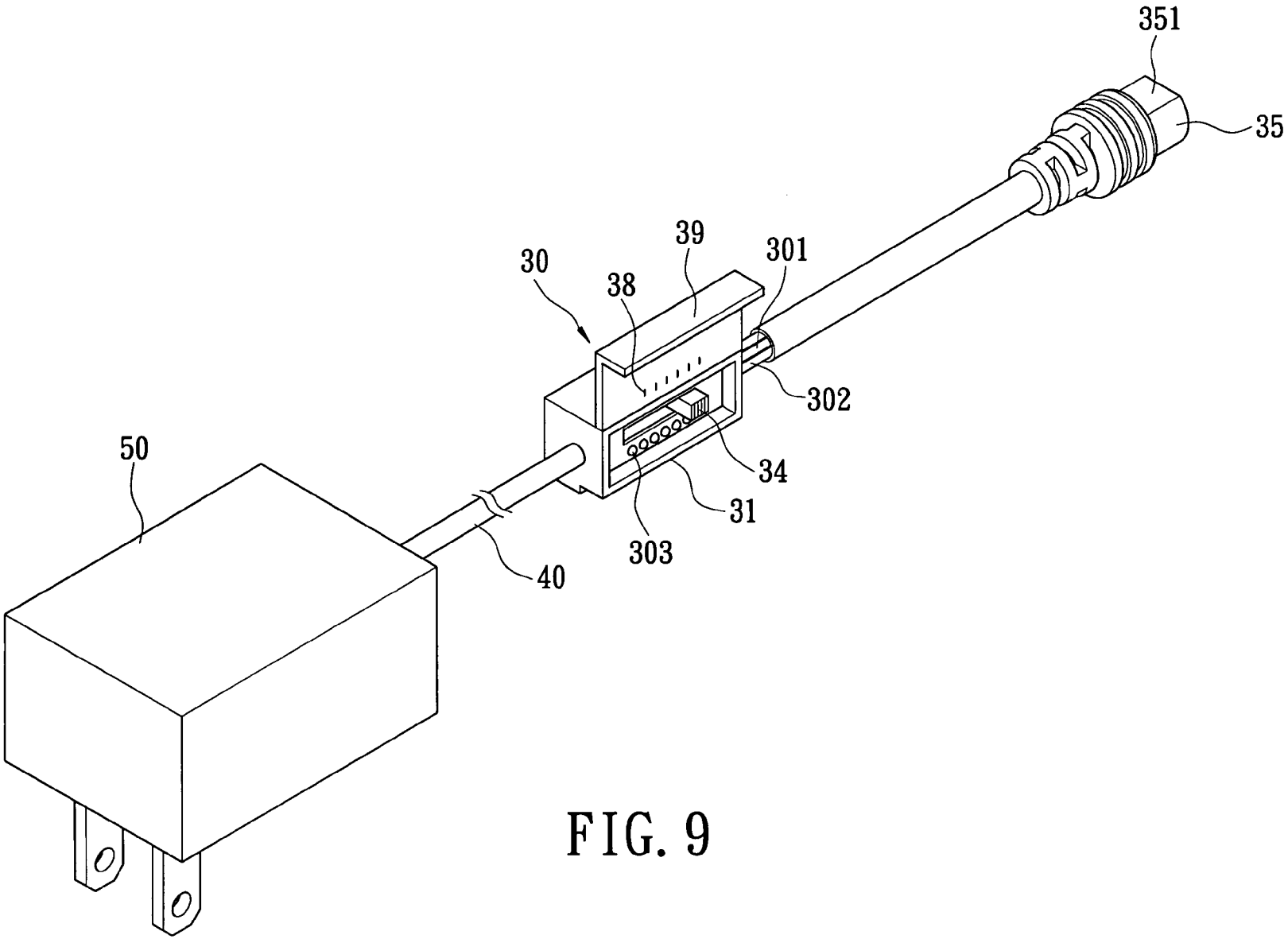
FIG. 9 is a perspective view of an intermediate adaptor of a third embodiment of a conversion plug structure of the present invention.

FIG. 9 shows a third embodiment of the present invention. The intermediate adaptor 30 has a plurality of light-emitting diodes 303 disposed on the insulating housing 31 to display various resistances.

Figure 10:
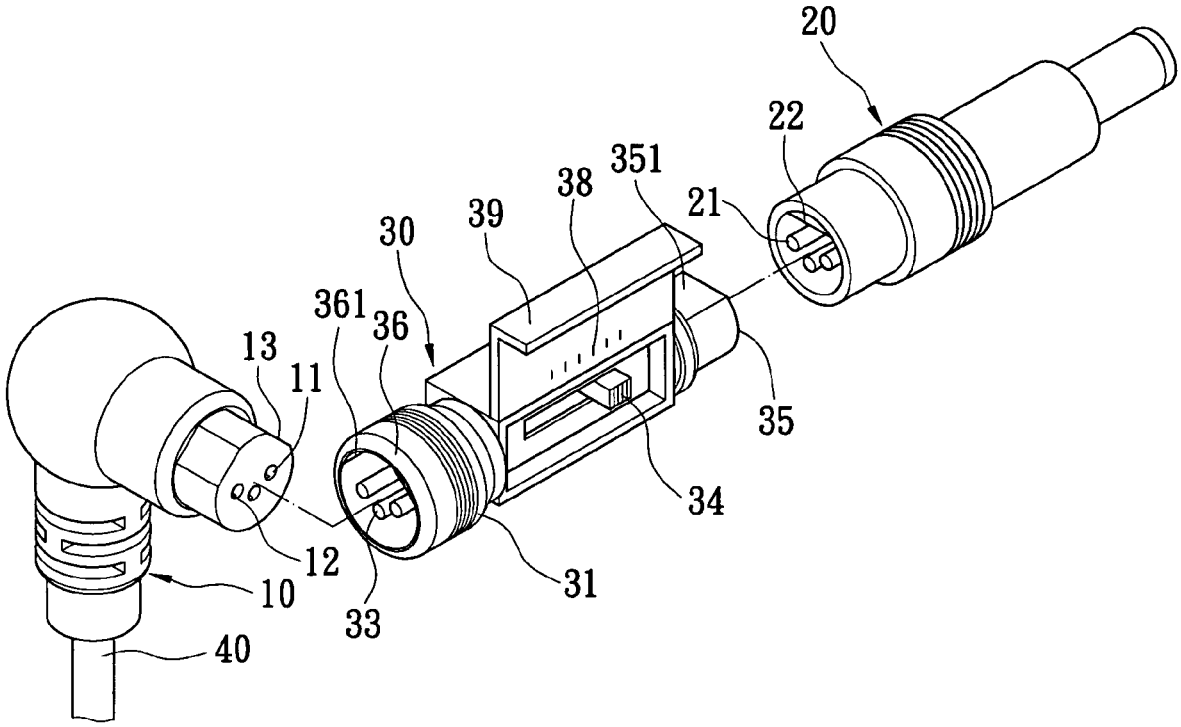
FIG. 10 is an exploded perspective view of a fourth embodiment of a conversion plug structure of the present invention.

FIG. 10 shows a fourth embodiment of the present invention. The conversion plug structure further has a plug 10 disposed between the intermediate adaptor 30 and the power cord 40. The plug 10 defines a plurality of second insertion holes 11 (such as a quantity of three) at an end thereof. The second insertion holes 11 extend inwardly a proper length. The plug 10 has a plurality of fourth terminals 12 made of metal materials with good conductively and respectively disposed in the second insertion holes 11. Each of the fourth terminals 12 has an end electrically connecting with conductive wires (not shown) in the power cord 40, respectively. The intermediate adaptor 30 has a plurality of third terminals 33. The insulating housing 31 forms a second insertion portion 36 at another end thereof. The second insertion portion 36 corresponds to the end of the plug 10. The second insertion portion 36 connects with the end of the plug 10. In other words, the second insertion portion 36 sleeves around the end of the plug 10, so that the intermediate adaptor 30 connects with the plug 10 in an insertion and a changeable manner.

The second insertion portion 36 has a tangent plane 361 disposed at an inside thereof, and the plug 10 has a corresponding tangent plane 13 disposed at the end thereof, so as to form an anti-disorientation device. Therefore, the connection between the intermediate adaptor 30 and the plug 10 has to follow a certain direction when both are inserted into each other.

The third terminals 33 are made of metal materials with good conductivity and are disposed in another end of the insulating housing 31. Each of the third terminals 33 has an end disposed in the second insertion portion 36. When the second insertion portion 36 of the intermediate adaptor 30 connects with the end of the plug 10, the third terminals 33 electrically connect with the fourth terminals 12 of the plug 10. One of the third terminals 33 serves as a grounding terminal. The variable resistor 34 connects between said one of the second terminals 32 and said one of the third terminals 33, and the rest of the second terminals 32 electrically connects with the rest of the third terminals 33 properly.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A conversion plug structure having a variable resistor, comprising:

a conversion adaptor having a plurality of first terminals disposed therein; and an intermediate adaptor having:

an insulating housing having a plurality of second terminals disposed therein;

a variable resistor extending through an opening in said housing and being electrically connected between one of the second terminals and the power cord, the rest of the second terminals being electrically connected with the power cord;

a cover being connected to the insulating housing and operable into an open position and a closed position, the variable resistor being inaccessible when the cover is in the closed position, the inside of the cover being marked with indicia, said indicia being visible when the cover is in the open position;

wherein the conversion adaptor matingly connects with the intermediate adaptor thereby electrically connecting the second terminals with the first terminals, the variable resistor of the intermediate adaptor setting output voltage.

2. The conversion plug structure as claimed in claim 1, wherein the intermediate adaptor has a plurality of light-emitting diodes disposed on the insulating housing to display various resistances.

3. The conversion plug structure as claimed in claim 1, wherein the intermediate adaptor has a plurality of third terminals the conversion plug structure further having a plug disposed between the intermediate adaptor and the power cord, the plug having a plurality of fourth terminals, each of the fourth terminals having an end electrically connected with the power cord, wherein the intermediate adaptor matingly connects with the plug electrically connecting the third terminals with the fourth terminals, the variable resistor being electrically connected between said one of the second terminals and said one of the third terminals, the rest of the second terminals being electrically connected with the rest of the third terminals.

* * * * *